US011161138B2

(12) United States Patent
Gao et al.

(10) Patent No.: US 11,161,138 B2
(45) Date of Patent: Nov. 2, 2021

(54) LOW-FREQUENCY ULTRASONIC ATOMIZING DEVICE HAVING LARGE ATOMIZATION QUANTITY

(71) Applicant: JIANGSU UNIVERSITY, Jiangsu (CN)

(72) Inventors: Jianmin Gao, Jiangsu (CN); Xu Liu, Jiangsu (CN)

(73) Assignee: JIANGSU UNIVERSITY

( * ) Notice: Subject to any disclaimer, the term of this patent is extended or adjusted under 35 U.S.C. 154(b) by 145 days.

(21) Appl. No.: 16/604,882

(22) PCT Filed: May 17, 2017

(86) PCT No.: PCT/CN2017/084644
§ 371 (c)(1),
(2) Date: Oct. 11, 2019

(87) PCT Pub. No.: WO2018/192039
PCT Pub. Date: Oct. 25, 2018

(65) Prior Publication Data

US 2020/0122184 A1 Apr. 23, 2020

(30) Foreign Application Priority Data

Apr. 18, 2017 (CN) ..... 201710254527.0

(51) Int. Cl.
*B05B 17/00* (2006.01)
*B05B 17/06* (2006.01)
*B05B 7/06* (2006.01)

(52) U.S. Cl.
CPC ..... *B05B 17/0669* (2013.01); *B05B 7/066* (2013.01); *B05B 17/0615* (2013.01)

(58) Field of Classification Search
CPC . B05B 17/0669; B05B 7/066; B05B 17/0615; B05B 7/2424; B05B 7/0433;
(Continued)

(56) References Cited

U.S. PATENT DOCUMENTS 3,806,029 A 4/1974 Hughes ..... 239/3
4,408,719 A * 10/1983 Last ..... G10K 5/02 239/417

(Continued)

FOREIGN PATENT DOCUMENTS

CN 102294313 12/2011 ..... B05B 1/12
CN 102500502 6/2012 ..... B05B 17/06

(Continued)

OTHER PUBLICATIONS

International Search Report (w/translation) and Written Opinion (w/machine translation) issued in application No. PCT/CN/2017/085442, dated Feb. 7, 2018 (12 pgs).

(Continued)

*Primary Examiner* — Qingzhang Zhou
(74) *Attorney, Agent, or Firm* — Hayes Soloway P.C.

(57) ABSTRACT

A low-frequency ultrasonic atomizing device includes a piezoelectric vibrator, a horn, a secondary atomizing chamber, a gas-liquid valve end cover, a Laval-type valve core, a stepped valve core, and a gas-liquid valve body. The piezoelectric vibrator is glued onto the horn, and the gas-liquid valve end cap is connected to the gas-liquid valve body by a thread, while both the stepped valve core and the Laval-type valve core are installed within a cylindrical cavity of the valve body, an end of the Laval-type valve core being sleeved at an end of the stepped valve core. The horn and the secondary atomizing chamber, the secondary atomizing chamber and the gas-liquid valve end cover are connected by a double-head stud and a nut. The device achieves multi-stage atomization of droplets, which increases the atomization quantity of a spray device, the droplets being small, and also achieves long distance spraying.

10 Claims, 2 Drawing Sheets

(58) Field of Classification Search
CPC ..... B05B 17/0623; B05B 17/0661; B05B 17/0607; B05B 17/0653
USPC ..... 239/102.2
See application file for complete search history.

(56) References Cited

U.S. PATENT DOCUMENTS

| | | | | |
|---|---|---|---|---|
| 5,501,401 | A | 3/1996 | Munk | 239/431 |
| 6,126,086 | A | 10/2000 | Browner et al. | 239/102.1 |
| 2008/0054091 | A1* | 3/2008 | Babaev | B01F 3/08 239/102.2 |
| 2008/0314314 | A1* | 12/2008 | Erickson | B05B 7/02 118/302 |
| 2009/0026291 | A1* | 1/2009 | Shimada | B05B 7/066 239/405 |
| 2019/0054492 | A1 | 2/2019 | Gao et al. | B05B 17/0607 |

FOREIGN PATENT DOCUMENTS

| | | | |
|---|---|---|---|
| CN | 203508288 | 4/2014 | B05B 17/06 |
| CN | 105834054 | 8/2016 | B05B 17/06 |
| CN | 106423607 | 2/2017 | B05B 7/04 |

OTHER PUBLICATIONS

International Search Report and Written Opinion (w/translations) issued in application No. PCT/CN/2017/084644 dated Nov. 22, 2017 (14 pgs).

* cited by examiner

LOW-FREQUENCY ULTRASONIC ATOMIZING DEVICE HAVING LARGE ATOMIZATION QUANTITY

TECHNICAL FIELD

The invention relates to a low-frequency ultrasonic atomization device, belonging to the field of agricultural engineering atomization cultivation.

BACKGROUND ART

Ultrasonic atomizers are widely used in agricultural engineering due to their fine and uniform droplet size. At present, in the technical field of ultrasonic atomization, there are mainly two methods to generate power ultrasound: one is to use electroacoustic transducer to generate ultrasound, and the other is to use fluid as power to generate ultrasound. The two methods have their own advantages and disadvantages. The electro-acoustic transducer is used to atomize the droplets produced by the nozzle. The energy consumption is small. The droplet size changes with the design frequency of the piezoelectric vibrator. The higher the frequency, the smaller the droplet size. The disadvantage is that the smaller the amount of atomization, the larger the amount of atomization. However, the droplet size is not uniform. To obtain fine droplets, a high-power air compressor is required to provide compressed gas with high pressure and large flow rate. According to the invention, the piezoelectric ultrasonic atomization technology and the two-phase flow mechanics technology are combined to design a low-frequency ultrasonic atomization device which not only can generate relatively fine fog droplets but also has relatively large atomization quantity and relatively large range of spray effects.

The existing ultrasonic atomizing nozzle has the following disadvantages:

1. The atomization amount is small. Because the low-frequency ultrasonic atomizing device is equipped with a Laval valve core, high-speed air flow can be formed at the outlet, and large atomizing quantity can be generated in a short time.
2. The droplet diameter is large. Because the low-frequency ultrasonic atomizing device adopts a secondary atomizing cavity structure, droplets atomized by mixing with sonic gas flow directly or after rebounding for many times hit the atomizing end face of the ultrasonic atomizing nozzle to carry out secondary atomization, so that finally atomized droplets have smaller particle sizes.

SUMMARY OF THE INVENTION

Aiming at the defects of the prior art, the invention provides a low-frequency ultrasonic atomization device with large atomization amount, which combines the advantages of ultrasonic atomization technology and two-phase flow mechanics technology to realize multiple atomization of fog droplets, thereby improving the atomization amount of a nozzle, reducing the average particle diameter of the fog droplets and making the particle diameter of the fog droplets more uniform.

The specific technical scheme adopted by the invention is as follows:

The invention relates to a low-frequency ultrasonic atomizing device with large atomizing amount, which is characterized by comprising a piezoelectric vibrator, an amplitude transformer, a secondary atomizing cavity, an air-liquid valve end cover, a sealing ring, a Laval valve core, a stepped valve core and an air-liquid valve body, wherein the amplitude transformer is a stepped deformation amplitude transformer with an exponential transition section. The secondary atomizing cavity is provided with a cylindrical inner cavity with one end open, and conical gas-liquid inlet piezoelectric vibrators and copper sheet electrodes communicated with the bottom of the cylindrical inner cavity are arranged at intervals in sequence; two sides of the secondary atomizing cavity are clamped by a piezoelectric vibrator front cover plate and a piezoelectric vibrator rear cover plate; the piezoelectric vibrator front cover plate is glued at one end of an amplitude transformer; the other end of the amplitude transformer extends into the secondary atomizing cavity inner cavity; the cylindrical side surface and the atomizing end surface of the amplitude transformer are respectively provided with a spacing of 1-2 mm with the cylindrical surface and the annular surface of the secondary atomizing cavity; and a sealing sleeve is arranged between the cylindrical side surface of the amplitude transformer and the cylindrical surface of the secondary atomizing cavity inner cavity;

The valve body of that gas-liquid valve is provide with a stepped cylindrical cavity, and the stepped valve core and the Laval valve core are position in the cylindrical cavity of the valve body of the gas-liquid valve;

The diameter of the middle section of the stepped valve core is smaller than the diameter of the end parts at both ends; the center of the stepped valve core is provided with a through hole along the axial direction; one end of the stepped valve core is contacted with a cylindrical cavity to play a role of radial positioning; the inlet end of the laval valve core is provided with a cylindrical groove which is sleeved at the other end of the stepped valve core The seal ring is assemble between that gas-liquid valve end cover and the Laval valve core, and the gas-liquid valve end cover is provided with a gas-liquid outlet;

Flanges are respectively arranged on the circular surface of the zero amplitude surface of the amplitude transformer, the secondary atomizing cavity and the outer circular surface of the end cover of the gas-liquid valve, and the gas-liquid outlet of the end cover of the gas-liquid valve is directly opposite to the conical gas-liquid inlet through stud bolts and nuts respectively between the amplitude transformer and the secondary atomizing cavity and between the secondary atomizing cavity and the end cover of the gas-liquid valve.

Further, the vibration frequency of the main body of the ultrasonic atomizing nozzle composed of the piezoelectric vibrator rear cover plate, the copper sheet electrode, the piezoelectric vibrator front cover plate and the horn is 50-65 KHZ.

Further, the diameter of the horn is 15 mm, the diameter of the atomizing end surface is 5 mm, and the length is 45 mm.

Further, the inner cavity of the secondary atomizing cavity is stepped, the diameter of the large end is 6 mm, the diameter of the small end is 4 mm, and the diameters of the two end surfaces of the conical gas-liquid inlet are 3 mm and 5 mm respectively.

Further, the outer circumferential surface of the end cover of the gas-liquid valve is provided with a flange, the diameter of the connecting hole is 4 mm, one end is provided with a gas-liquid outlet with a diameter of 4 mm, the other end is provided with a cylindrical groove, and the inner surface of the cylindrical groove is provided with an internal thread.

Further, the sealing ring is assembled between the end cover of the gas-liquid valve and the Laval valve core and is provided with a through hole, the diameter of the through hole is 4 mm, and the thickness of the sealing ring is 1.5 mm.

Further, the inlet diameter of the contraction end of the Laval type valve core is 4.9 mm, the throat diameter is 1.8 mm, and the outlet diameter of the expansion end surface is 4.3 mm.

Further, the diameter of the drainage hole on the laval valve core is 1-1.6 mm.

Further, the diameter of the axial through hole of the stepped valve core is 5 mm.

High-pressure gas of 3-6 bar enters through the air inlet hole on the end face of the valve body of the gas-liquid valve, the gas passing through the stepped valve core and the laval valve core is accelerated to sonic speed or supersonic speed, the liquid to be atomized flows in through the drainage hole near the outlet of the laval tube and is mixed with sonic gas flow to realize first atomization, and the gas-liquid mixture after the first atomization flows out at high speed along with the high-speed gas flow through the central hole of the end cover of the gas-liquid valve. And flows through the secondary atomization cavity and enters the secondary atomization cavity along the conical gas-liquid inlet, the gas-liquid mixture impacts the end face of the vibrating amplitude transformer to realize secondary atomization, and then droplets subjected to secondary atomization are ejected from the conical gas-liquid inlet again after being repeatedly bounced and atomized in the secondary atomization cavity under the drive of high-speed airflow; and the multiple reflection atomization in the secondary atomization cavity further reduces the droplet diameter of larger droplets in the droplet group, and the droplet diameter is more uniform after multiple atomization, and the atomization amount is obviously improved.

The invention has the advantages that:

1. Before being subjected to ultrasonic atomization, fog droplets undergo first atomization under the blow and collision of high momentum of supersonic gas, then undergo second atomization under the action of ultrasonic vibration, and finally realize multi-stage atomization through repeated rebound atomization in a secondary atomization cavity. However, the atomization object of the traditional piezoelectric ultrasonic atomizer is a liquid film, so the atomization amount of the invention is larger and the fog drops are finer than that of the traditional piezoelectric ultrasonic atomizer.

2. As a secondary atomizing cavity is added at the gas-liquid outlet of the gas-liquid valve body, the droplets of the gas-liquid mixture atomized for the first time are further cracked and reduced under the action of high-speed airflow in the secondary atomizing cavity, so that the droplets are more uniform.

In the picture:

1—piezoelectric vibrator rear cover plate, 2—copper sheet electrode, 3—piezoelectric vibrator, 4—piezoelectric vibrator front cover plate, 5—amplitude transformer, 6—secondary atomizing cavity, 7—gas-liquid valve end cover, 8—sealing ring, 9—drainage hole, 10—laval valve core, 11—stepped valve core, 12—gas-liquid valve body, 13—liquid inlet hole, 14—air inlet hole, 15—first nut, 16—first stud, 17—second stud, 18—second nut, 19—inner cavity, 20—conical gas-liquid inlet, 21—sealing sleeve.

DETAILED DESCRIPTION OF THE PREFERRED EMBODIMENT

The present invention will be further described below with reference to the drawings and specific embodiments, but the scope of protection of the present invention is not limited thereto.

Figure 1:
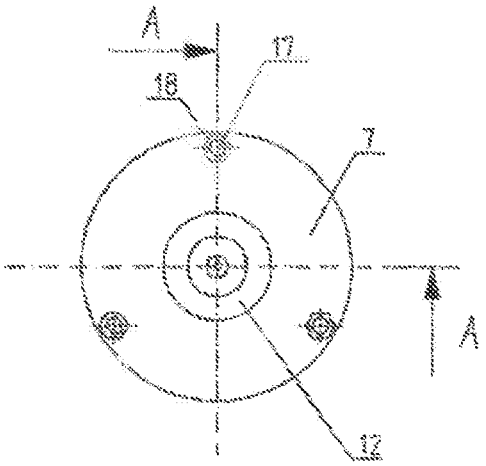
FIG. 1 is a front view of the low-frequency ultrasonic atomizing device with large atomizing amount according to the present invention.
Figure 2:
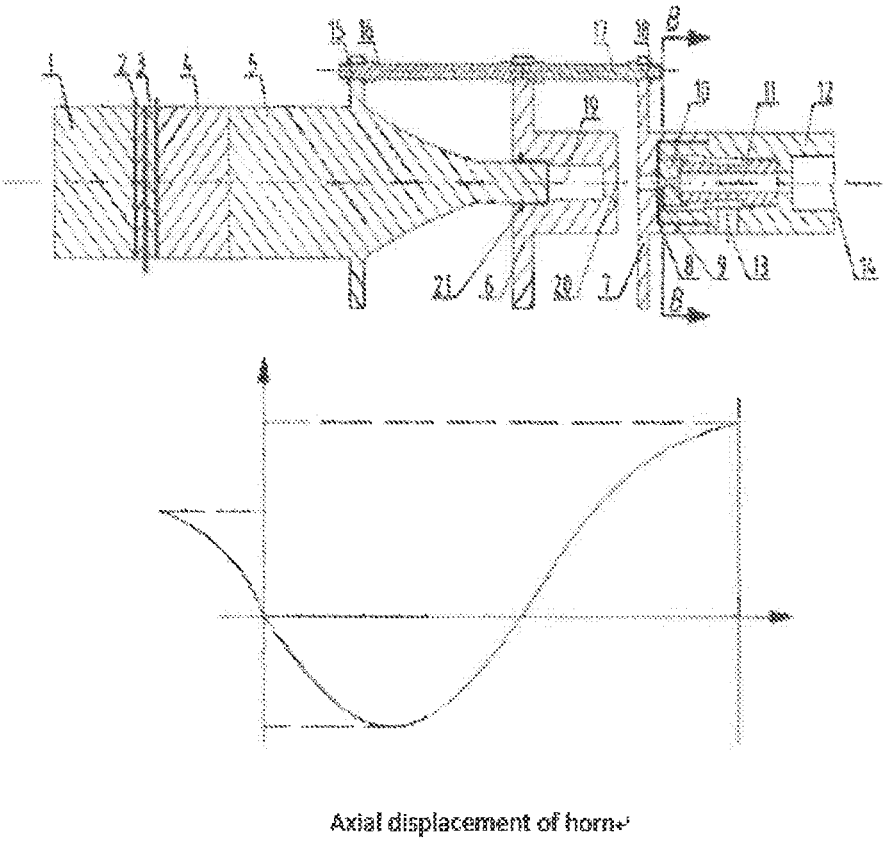
FIG. 2 is a cross-sectional view of the low-frequency ultrasonic atomizing device with large atomizing amount in the figure along the direction A-A and the relation between the axial displacement amplitude and the cross-sectional view.

As shown in figs. 1 and 2, the main body length of the large atomization volume low-frequency ultrasonic atomization device is 110 mm, the length of the ultrasonic atomization nozzle part is 70 mm, the length of the secondary atomization cavity is 15 mm, the distance between the gas-liquid inlet end face of the secondary atomization cavity and the end face of the gas-liquid valve end cover is 3 mm, and the length of the gas-liquid valve body is 28 mm. The low-frequency ultrasonic atomizing device with large atomizing amount comprises a piezoelectric vibrator-3, an amplitude transformer-5, a secondary atomizing cavity-6, a gas-liquid valve end cover-7, a sealing ring-8, a Laval valve core-10, a stepped valve core-11 and a gas-liquid valve body-12. The amplitude transformer-5 is a stepped amplitude transformer with an exponential transition section and is made of hard aluminum 7057. The diameter of the amplitude transformer-5 is 15 mm and the diameter of the atomizing end surface is 5 mm. The length of the horn is 45 mm, i.e. ¾ wavelength. The secondary atomizing cavity-6 is provided with a cylindrical inner cavity-19 with one end open and a conical gas-liquid inlet-20 communicated with the bottom of the cylindrical inner cavity. The inner cavity-19 of the secondary atomization cavity-6 is used for realizing multi-stage atomization, and the inner cavity-19 of the secondary atomization cavity-6 is stepped, the diameter of the large end is 6 mm, and the diameter of the small end is 4 mm. The diameters of the two end faces of the conical gas-liquid inlet-20 are 3 mm and 5 mm respectively, thus reducing the resistance and facilitating the high-speed gas-liquid mixture to smoothly enter the secondary atomizing cavity-6.

The piezoelectric vibrator and the copper sheet electrode are sequentially arranged at intervals, and the two sides are clamped by a piezoelectric vibrator front cover plate and a piezoelectric vibrator rear cover plate, and the piezoelectric vibrator front cover plate and the amplitude transformer are coaxially bonded into a whole. The vibration frequency of the main body of the ultrasonic atomizing nozzle consisting of a piezoelectric vibrator rear cover plate-1, a copper sheet electrode-2, a piezoelectric vibrator front cover plate-4 and an amplitude transformer-5 is 50-60 KHZ.

The other end of the amplitude transformer-5 extends into the inner cavity-19 of the secondary atomizing cavity-6 and the cylindrical side surface and the atomizing end surface of the amplitude transformer-5 are respectively spaced apart from the cylindrical surface and the annular surface of the inner cavity-19 of the secondary atomizing cavity-6 by 1-2 mm; A sealing sleeve is arranged between the cylindrical side surface of the amplitude transformer and the cylindrical surface of the secondary atomizing cavity to prevent the high-pressure gas-liquid mixture in the secondary atomizing cavity from leaking from the annular gap between the cylindrical surface of the end of the amplitude transformer and the internal cavity of the secondary atomizing cavity to cause droplet loss. The gas-liquid valve body-12 is provided with a cylindrical cavity, and the stepped valve core-11 and the Laval valve core-10 are positioned in the cylindrical cavity of the gas-liquid valve body-12.

Figure 3:
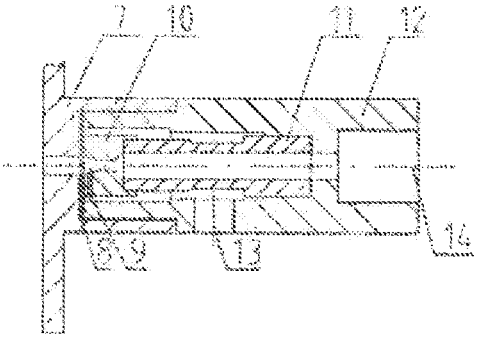
FIG. 3 is a partial sectional view of a valve body of a gas-liquid valve.

As shown in FIG. 3, the diameter of the middle section of the stepped valve core-11 is smaller than the diameter of the end parts at both ends. The center of the stepped valve core-11 is provided with a through hole along the axial direction. One end of the stepped valve core contacts with the cylindrical cavity to play a role of radial positioning. The inlet diameter of the contraction end of the Laval valve core-10 is 4.9 mm, the throat diameter is 1.8 mm, and the outlet diameter of the expansion end surface is 4.3 mm.

Figure 4:
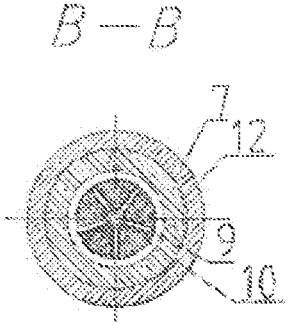
FIG. 4 is a plane sectional view of the axis of five drainage holes of laval valve core.

The inlet end of the Laval valve core-10 is provided with a cylindrical groove which is sleeved at the other end of the stepped valve core-11 and plays a role of radial positioning, thus ensuring the concentricity between the Laval valve core-10 and the stepped valve core-11. The stepped valve core-11 is radially positioned by a Laval valve core-10 and a gas-liquid valve body-12 through a cylindrical groove, and the axial through hole diameter of the stepped valve core-11 is 5 mm. A cavity, i.e. an annular channel, is formed between the outer circular surface of the stepped valve core-11 and the inner circular surface of the groove of the valve body of the gas-liquid valve-12, the side surface of the cylindrical cavity of the valve body of the gas-liquid valve-12 is provided with a liquid inlet hole-13 at a position corresponding to the axial midpoint of the stepped valve core-11, the end surface is provided with an air inlet hole-14, and the side wall at the outlet of the Laval valve core-10 is provided with five radial drainage holes-9, as shown in FIG. 4. The diameter of the drainage hole-9 is 1-1.6 mm. The liquid to be atomized flows in from the liquid inlet hole-13, flows through the annular cavity to realize shunt, further flows into the drainage hole-9 finally, and then the supersonic gas blows away and impacts the liquid flowing out of the drainage hole-9 to realize first atomization.

One end of the end cover of the gas-liquid valve-7 is provided with a gas-liquid outlet with a diameter of 4 mm, the other end is provided with a cylindrical groove, and the inner surface of the cylindrical groove is provided with an internal thread. The end cover of the gas-liquid valve-7 is screwed on the liquid outlet end of the valve body of the gas-liquid valve-12, the sealing ring-8 is assembled between the end cover of the gas-liquid valve-7 and the Laval valve core-10, and a through hole is formed, the diameter of the through hole is 4 mm, and the thickness of the sealing ring-8 is 1.5 mm. The end cover of the gas-liquid valve-7 is provided with a gas-liquid outlet. The gas-liquid mixture atomized for the first time flows out at high speed through the central hole of the end cover of the gas-liquid valve-7 and flows through the conical gas-liquid inlet of the secondary atomizing cavity-6, then enters the inner cavity-19 of the secondary atomizing cavity-6, the gas-liquid mixture is hit on the atomizing end surface of the amplitude transformer-5 to be atomized for the second time, and the gas-liquid mixture atomized for the second time rebounds and atomizes in the inner cavity-19 of the secondary atomizing cavity-6 for a plurality of times to finally realize multistage atomization of liquid.

Flange are respectively arranged on that circular surface of the zero amplitude surface of the amplitude transform-5, the secondary atomizing cavity-6 and the outer circular surface of the end cover of the gas-liquid valve-7, and the amplitude transform-S and the secondary atomizing cavity-6 are connected through three sets of first stud bolts-16 and first nuts-15; The secondary atomization cavity-6 is connected with the end cover of the gas-liquid valve-7 through three sets of second stud bolts-17 and second nuts-18; Realize axial and radial positioning. The gas-liquid outlet of the end cover of the gas-liquid valve-7 faces the conical gas-liquid inlet-20.

Figure 5:
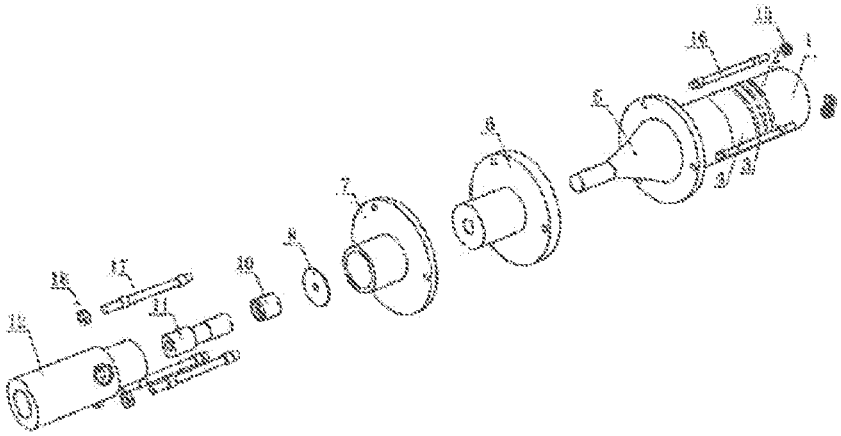
FIG. 5 is an exploded view of the low-frequency ultrasonic atomizing device with large atomizing amount.

As shown in FIG. 5, during assembly, the rear cover plate-1, the copper sheet electrode-2, the front cover plate-4 and the amplitude transform-5 are integrally bonded by centering. First, the three first studs-16 are screwed into the three threaded holes on the flange disc on the outer circular surface of the secondary atomizing cavity-6, and then the three first studs-16 are inserted into the three through holes on the zero amplitude surface of the amplitude transformer-5 through centering until the stepped cylindrical annular surface on the first stud close to the zero amplitude surface of the amplitude transformer is pushed against the zero amplitude surface, while the inner cavity-19 of the secondary atomizing cavity-6 is sleeved on the atomizing end cylinder of the amplitude transformer-5, and the assembly of the ultrasonic atomizing nozzle and the secondary atomizing cavity-6 is completed by screwing the three first nuts-15. Further, the other end of the stepped valve core-11 is inserted into the cylindrical cavity in the gas-liquid valve body-12 to complete the radial positioning of the stepped valve core and the gas-liquid valve body-11, and then the other end of the Laval valve core-10 is sleeved on one end of the stepped valve core-11 to complete the radial positioning of the Laval valve core-10 and the stepped valve core-11. Furthermore, the sealing ring-8 is coaxially installed in the end cover of the gas-liquid valve-7 and is tightly attached to the annular surface thereof, and then the assembly of the gas-liquid valve is completed through the threaded connection between the internal thread of the end cover of the gas-liquid valve equipped with the sealing ring and the external thread of the valve body of the gas-liquid valve. Furthermore, the three second studs-17 are screwed into the three threaded holes on the other side of the flange disc on the outer circumferential surface of the secondary atomization cavity-6, and then the three second studs-17 are inserted into the three through holes on the outer circumferential surface of the gas-liquid valve end cover through centering until the stepped cylindrical annular surface on the second stud close to the end surface of the gas-liquid valve end cover-7 is propped on the end surface of the gas-liquid valve end cover, and at the same time, the gas-liquid outlet of the gas-liquid valve and the conical gas-liquid inlet-20 of the secondary atomization cavity-6 are coaxially opposite, thus finally completing the assembly of the low-frequency ultrasonic atomization device with large atomization amount.

High-pressure gas is supplied by an air compressor, and an air inlet pipeline is connected with an air inlet hole-14 on the valve body of the gas-liquid valve-12; The liquid to be atomized is pumped by a hydraulic pump to a liquid inlet hole-13; The ultrasonic atomizing nozzle part of the device is driven by a driving power supply, the first and third copper sheet electrodes are connected with the negative electrode of the power supply, the second copper sheet electrode-2 is connected with the positive electrode of the power supply, and the driving frequency is 50-60 KHZ.

Working process: 3-6 bar of high-pressure gas enters through the air inlet at the end face of the valve body of the gas-liquid valve-12, the gas passing through the stepped valve core and the Laval valve core is accelerated to sonic speed or supersonic speed (mach 1.3-1.6), the liquid to be atomized flows in through the drainage hole near the Laval pipe outlet and is mixed with sonic gas flow to generate blowing and collision effects, thus realizing first atomization. Atomized liquid droplets enter the secondary atomization cavity along the conical gas-liquid inlet along the high-speed gas flow, i.e. the gas-liquid mixture, and impact the end face of the vibrating amplitude transformer to realize secondary atomization; then the atomized droplets are driven by the high-speed gas flow to be repeatedly reflected and atomized in the secondary atomization cavity and then are sprayed out from the conical gas-liquid inlet again; and the multiple reflection atomization in the secondary atomization cavity further reduces the droplet diameter of larger droplets in the droplet group, and the droplet diameter is more uniform and the atomization amount is obviously improved after multiple atomization.

The distance between the atomizing end surface of the horn and the annular surface at the end of the secondary atomizing cavity far away from the conical gas-liquid inlet is about 1 mm, leaving enough space for the vibration of the atomizing end surface of the horn to prevent interference collision from affecting the atomizing effect.

The described embodiment is the preferred embodiment of the present invention, but the present invention is not limited to the above embodiments, and any obvious improvement, substitution or modification that can be made by a person skilled in the art without departing from the essence of the present invention are within the scope of protection of the present invention.

The invention claimed is:

1. A low-frequency ultrasonic atomization device with a large atomization volume, said device comprising a piezoelectric vibrator, an amplitude transformer, a secondary atomization cavity, a gas-liquid valve end cover, a sealing ring, a Laval valve core, a stepped valve core and a gas-liquid valve body;

wherein the amplitude transformer is a stepped amplitude transformer with an exponential transition section, and the secondary atomizing cavity is provided with a cylindrical inner cavity with an opening at one end and a conical gas-liquid inlet communicating with the bottom of the cylindrical inner cavity;

the piezoelectric vibrator and a copper sheet electrode are sequentially arranged at intervals, two sides of the piezoelectric vibrator are clamped by a piezoelectric vibrator front cover plate and a piezoelectric vibrator rear cover plate, the piezoelectric vibrator front cover plate is glued to one end of the amplitude transformer, the other end of the amplitude transformer extends into the cylindrical inner cavity of the secondary atomization cavity, and the cylindrical side surface and an atomization end surface of the amplitude transformer are respectively left with a spacing of 1-2 mm from an cylindrical surface and an annular surface of the cylindrical inner cavity of the secondary atomization cavity;

a sealing sleeve is arrange between the cylindrical side surface of the amplitude transformer and the cylindrical surface of the inner cavity of the secondary atomizing cavity;

the valve body of the gas-liquid valve is provide with a stepped cylindrical cavity, and the stepped valve core and the Laval valve core are position in the stepped cylindrical cavity of the valve body of the gas-liquid valve;

a diameter of the middle section of the stepped valve core is smaller than a diameter of the two end parts, a center of the stepped valve core is provided with an axial through hole, one end of the stepped valve core is contacted with a cylindrical cavity to play a role of radial positioning, an inlet end of the laval valve core is provided with a cylindrical groove, the cylindrical groove is sleeved on the other end of the stepped valve core, and a cavity is formed between the outer circumferential surface of the stepped valve core and the inner circumferential surface of the groove of the gas-liquid valve body, the side surface of the stepped cylindrical cavity of the gas-liquid valve body is provided with a liquid inlet hole at a position corresponding to an axial midpoint of the stepped valve core, the end surface is provided with an air inlet hole, and the side wall at the outlet of the laval valve core is provided with a plurality of radial drainage holes;

the gas-liquid valve end cover is screwed on the liquid outlet end of the gas-liquid valve body, the sealing ring is assembled between the gas-liquid valve end cover and the laval valve core, and the gas-liquid valve end cover is provided with a gas-liquid outlet;

flanges are respectively arranged on the circular surface of the zero amplitude surface of the amplitude transformer, the secondary atomizing cavity and the outer circular surface of the end cover of the gas-liquid valve, and the gas-liquid outlet of the end cover of the gas-liquid valve is directly opposite to the conical gas-liquid inlet through stud bolts and nuts respectively between the amplitude transformer and the secondary atomizing cavity and between the secondary atomizing cavity and the end cover of the gas-liquid valve.

2. The low-frequency ultrasonic atomizing device according to claim 1, wherein a vibration frequency of a main body of the ultrasonic atomizing nozzle comprising a piezoelectric vibrator rear cover plate, a copper sheet electrode, a piezoelectric vibrator front cover plate and an amplitude transformer is 50-65KHZ.

3. The low-frequency ultrasonic atomizing device according to claim 1, wherein the diameter of the amplitude transformer is 15 mm, the diameter of the atomizing end surface is 5 mm, and the length is 45 mm.

4. The low-frequency ultrasonic atomizing device according to claim 1, wherein the inner cavity of the secondary atomizing cavity is stepped, the diameter of the large end is 6 mm, the diameter of the small end is 4 mm, and the diameters of the two end surfaces of the conical gas-liquid inlet are 3 mm and 5 mm respectively.

5. The low-frequency ultrasonic atomizing device according to claim 1, wherein the outer circumferential surface of the end cover of the gas-liquid valve is provided with a flange, the diameter of the connecting hole is 4 mm, one end is provided with a gas-liquid outlet with a diameter of 4 mm, the other end is provided with a cylindrical groove, and the inner surface of the cylindrical groove is provided with an internal thread.

6. The low-frequency ultrasonic atomizing device according to claim 1, wherein the sealing ring is assembled between the end cover of the gas-liquid valve and the Laval valve core and is provided with a through hole, the diameter of the through hole is 4 mm, and the thickness of the sealing ring is 1.5 mm.

7. The low-frequency ultrasonic atomizing device according to claim 1, wherein the laval valve has an inlet diameter of its contraction end of 4.9 mm, a throat diameter of 1.8 mm, and an outlet diameter of its expansion end surface of 4.3 mm.

8. The low-frequency ultrasonic atomizing device according to claim 1, wherein a diameter of the plurality of drainage holes on the Laval valve core is 1-1.6 mm.

9. The low-frequency ultrasonic atomizing device according to claim 1, wherein a diameter of the axial through hole of the stepped valve core is 5 mm.

10. The low-frequency ultrasonic atomizing device according to claim 1, wherein a distance between the atomizing end surface of the amplitude transformer and the annular surface at the end of the secondary atomizing cavity far away from the conical gas-liquid inlet is about 1 mm.

* * * * *